US008801052B2

(12) United States Patent
Bender

(10) Patent No.: US 8,801,052 B2
(45) Date of Patent: Aug. 12, 2014

(54) HOOD LATCH

(75) Inventor: Jesse J. Bender, Waterloo, IA (US)

(73) Assignee: Deere & Company, Moline, IL (US)

( * ) Notice: Subject to any disclaimer, the term of this patent is extended or adjusted under 35 U.S.C. 154(b) by 450 days.

(21) Appl. No.: 12/685,339

(22) Filed: Jan. 11, 2010

(65) Prior Publication Data

US 2011/0169281 A1 Jul. 14, 2011

(51) Int. Cl.
*E05C 3/16* (2006.01)
*E05C 19/10* (2006.01)

(52) U.S. Cl.
USPC ..... 292/216; 292/DIG. 14

(58) Field of Classification Search
CPC ..... E05B 83/16; E05B 83/24; E05C 3/00; E05C 3/004; E05C 3/12; E05C 3/16; E05C 3/165; E05C 3/167; E05C 3/22; E05C 3/30
USPC ..... 292/DIG. 14, 95–100, 121–124, 126, 292/127, 129, 194–198, 200, 215–217, 292/219–224, 226, 227, 229, 240, DIG. 11, 292/DIG. 23, DIG. 42, 11, 225, 235, 236, 292/304, 341.12, DIG. 43
See application file for complete search history.

(56) References Cited

U.S. PATENT DOCUMENTS 2,924,473 A * 2/1960 Krause ..... 292/11
3,236,551 A * 2/1966 Nash ..... 292/11
3,378,289 A * 4/1968 Beckman et al. ..... 292/31
3,397,906 A * 8/1968 Beckman et al. ..... 292/29
3,905,624 A * 9/1975 Fujita ..... 292/11
3,985,381 A * 10/1976 Kobayashi ..... 292/216
4,530,412 A 7/1985 Sigety, Jr.
4,961,601 A * 10/1990 Lindholm et al. ..... 292/216
4,974,885 A * 12/1990 Yokoyama ..... 292/201
5,048,877 A * 9/1991 Rogers et al. ..... 292/110
5,118,146 A * 6/1992 Watanuki ..... 292/216
5,348,355 A * 9/1994 Oyha ..... 292/11
5,411,302 A * 5/1995 Shimada ..... 292/201
5,730,480 A * 3/1998 Takamura ..... 248/503.1
6,123,379 A * 9/2000 Yamada et al. ..... 296/65.03
6,422,616 B1 * 7/2002 Wortmann et al. ..... 292/216

(Continued)

OTHER PUBLICATIONS

Deere & Co, John Deere Hood Latch, pp. 1-6, (Unpublished images of prior production hood latch).

*Primary Examiner* — Carlos Lugo
*Assistant Examiner* — Alyson M Merlino

(57) ABSTRACT

A latch assembly includes a striker plate and a latch plate. The striker plate is pivotal to a locked position securing the latch assembly to a striker bar and to an unlocked position wherein the striker bar can be inserted and removed therefrom. The latch plate is pivotal on a pivot pin to a latched position holding the striker plate in its locked position and to an unlatched position wherein the striker plate can be pivoted into and out of its locked position. A latch pin projects from the latch plate. A lever is pivotally mounted on the pivot pin. The lever is engagable with the latch pin to move the latch member from the latched position to the unlatched position. The lever is longer than a length of the latch plate. A spring is coupled to the lever and biased to urge the lever away from the latch pin. A link coupled to the lever is operable to move the lever towards the latch pin. The latch plate is pivotal independently of the lever when the striker plate is pivoting to its locked position.

4 Claims, 3 Drawing Sheets

(56) References Cited

U.S. PATENT DOCUMENTS

| | | | | |
|---|---|---|---|---|
| 6,485,071 | B2 * | 11/2002 | Schwaiger | 292/216 |
| 6,695,360 | B1 * | 2/2004 | Lindh et al. | 292/216 |
| 7,261,337 | B2 * | 8/2007 | Nakagome et al. | 292/216 |
| 7,575,280 | B2 * | 8/2009 | Palomba et al. | 297/336 |
| 7,631,907 | B2 * | 12/2009 | Sato | 292/216 |
| 8,128,135 | B2 * | 3/2012 | Maeta et al. | 292/216 |
| 2005/0269854 | A1 * | 12/2005 | Lutzka et al. | 297/378.13 |
| 2008/0054151 | A1 * | 3/2008 | Shimura et al. | 248/503.1 |
| 2009/0056393 | A1 * | 3/2009 | Otsuka | 70/205 |

* cited by examiner

HOOD LATCH

FIELD OF THE INVENTION

The present invention relates to a latch assembly, such as a hood latch.

BACKGROUND OF THE INVENTION

It is known to latch a vehicle hood in the closed position by a latch mechanism which is releasable to permit the hood to be opened. For example, some commercially available tractors made by John Deere have a hood latch assembly which releasably latches to a striker member. This known latch assembly has a striker plate and a latch plate. The striker plate is pivotal to a locked position securing the latch assembly to the striker member and to an unlocked position wherein the latch assembly can be coupled to and uncoupled from the striker member. The latch plate is pivotal to a latched position holding the striker plate in its locked position and to an unlatched position wherein the striker plate can be pivoted into and out of its locked position. On vehicles, such as tractors, which have large hoods, dirt and debris can become lodged in the latch mechanism and cause the latch mechanism to require a large force to unlatch. This force can exceed what can easily be applied by an operator using a conventional release handle.

One way to solve this problem would be to modify the latch plate to include a longer lever arm, such as a lever arm twice the length of the latch's original lever arm. This would reduce the force required to open the hood latch. However, such a longer lever arm would increase the drag on the latch when trying to close the hood. This extra drag on the latch can prevent the latch from latching when attempting to close the hood. It would be desirable to provide a hood latch mechanism which can be easily released with a small release force, without interfering with its latching function.

SUMMARY OF THE INVENTION

Accordingly, an object of this invention is to provide a hood latch mechanism which can be easily released with a small release force.

A further object of the invention is to provide such a hood latch mechanism which can be easily perform its latching function.

These and other objects are achieved by the present invention, wherein a hood latch assembly releasably latches to a striker member. The latch assembly includes a striker plate and a latch plate. The striker plate is pivotal to a locked position securing the latch assembly to the striker member and to an unlocked position wherein the latch assembly can be coupled to and uncoupled from the striker member. The latch plate is pivotal to a latched position holding the striker plate in its locked position and to an unlatched position wherein the striker plate can be pivoted into and out of its locked position. According to the present invention, the latch assembly also includes a latch member which projects from the latch plate, a lever, and a spring. The lever is pivotal adjacent to the latch plate, and is engagable with the latch member to move the latch plate from the latched position to the unlatched position. The resilient member is coupled to the lever and biased to urge the lever away from the latch pin. A link is coupled to the lever and is operable to move the lever towards the latch member.

DESCRIPTION OF THE PREFERRED EMBODIMENT

Figure 1:
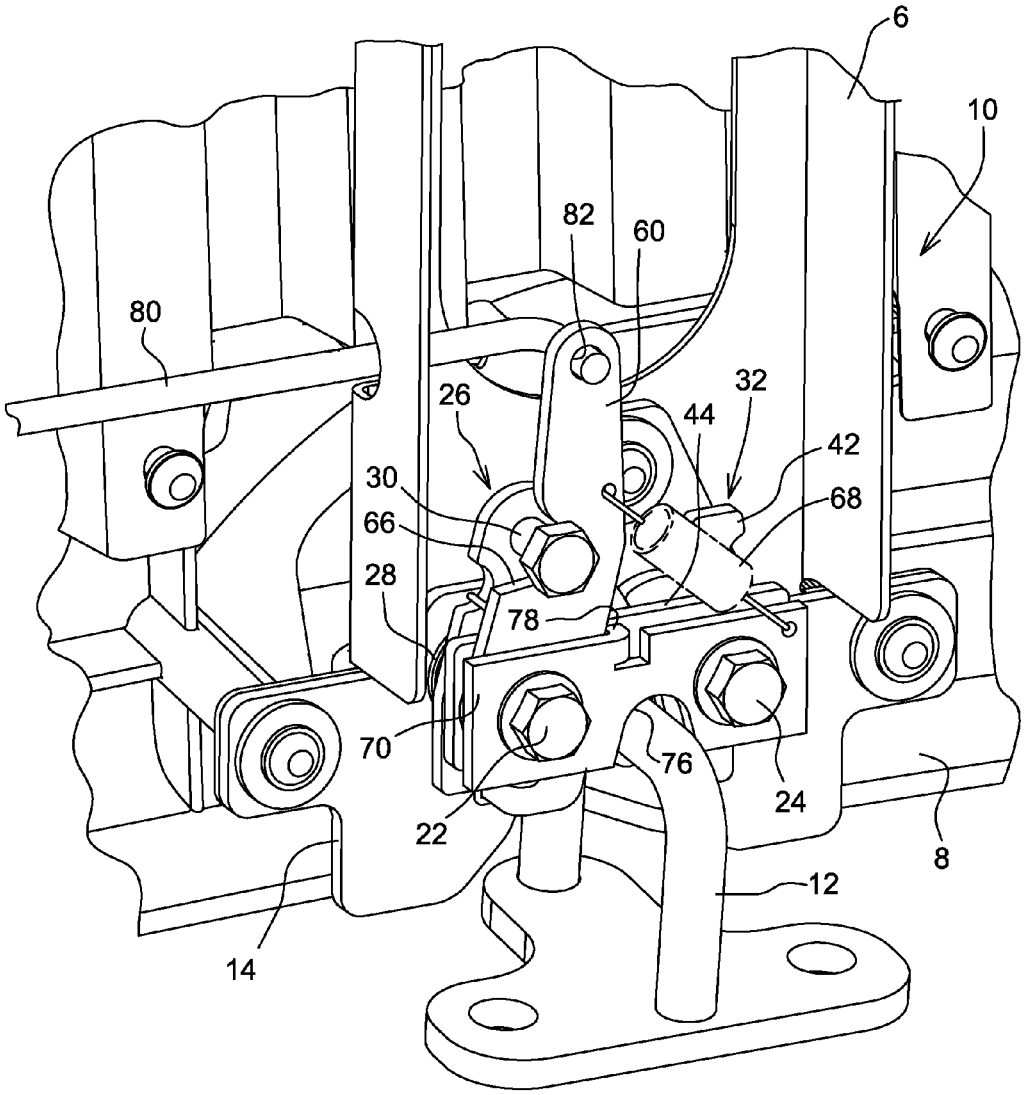
FIG. 1 is a rear perspective view of a latch assembly embodying the invention.
Figure 2:
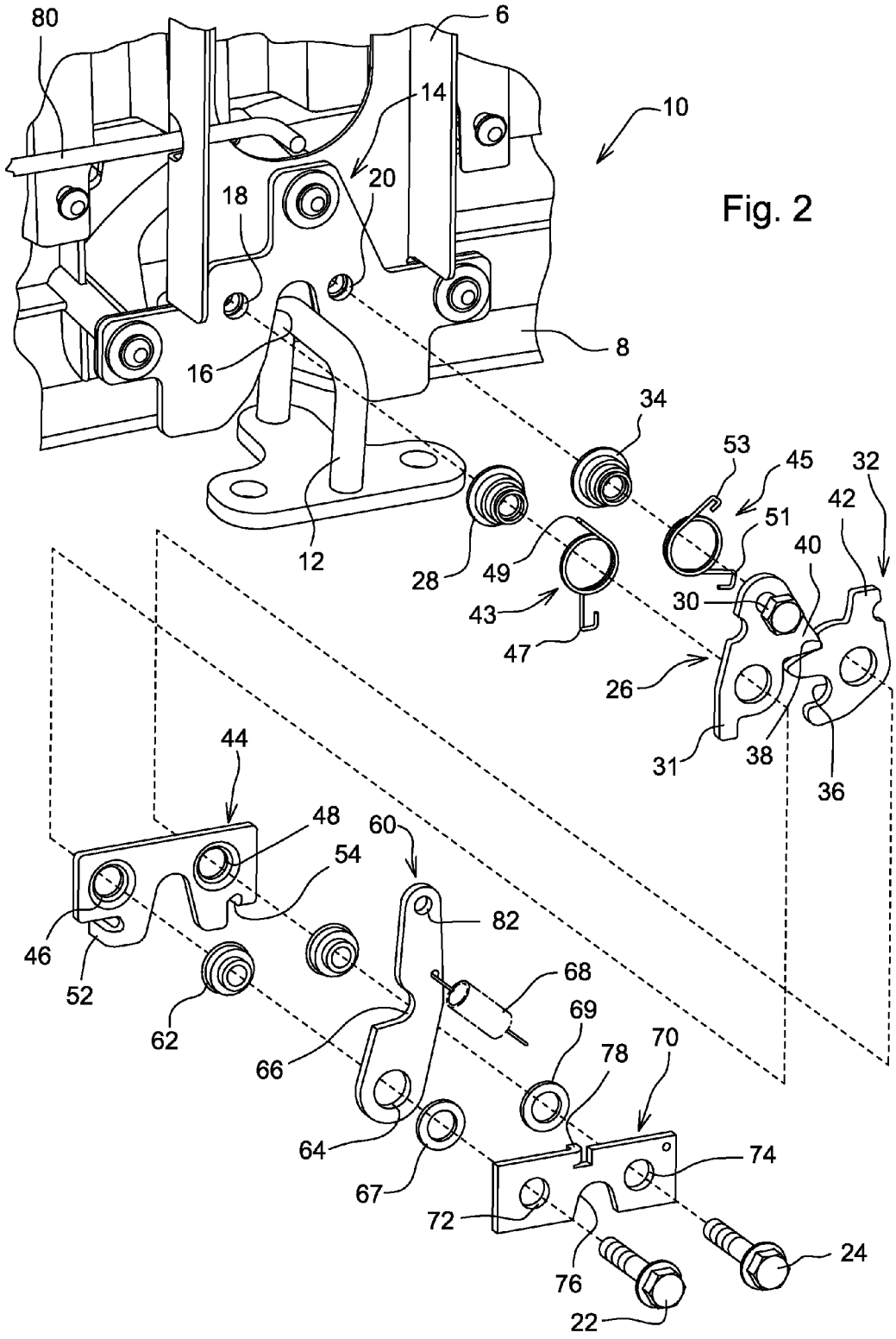
FIG. 2 is an exploded perspective view of the latch assembly of FIG. 1.

Referring to FIGS. 1 and 2, a hood latch assembly 10 is attached to a bracket 6 of a hood 8 and releasably latches to a striker member 12. The latch assembly 10 includes a base or mounting plate 14 which is attached to the hood bracket 6. Mounting plate 14 includes a downward opening central recess 16 for receiving the striker member 12. Bracket 6 includes a pair of threaded mounting bores 18 and 20 which receive pivot pins or bolts 22 and 24, respectively.

A latch plate 26 is pivotally mounted on a pivot stud or bearing 28 which is mounted on pivot pin 22 which forma a first pivot axis. A latch member or pin 30 projects from an upper end of latch plate 26. A tab 31 projects downwardly from a corner of the latch plate 26. A striker plate 32 pivotally mounted on a pivot stud or bearing 34 which is mounted on pivot pin 24. Striker plate 32 has fingers 35 and 37 which form a striker recess or slot 36 for releasably receiving the striker member 12. Striker plate 32 has a latch recess 38 for releasably receiving a latch point 40 of latch plate 26 so that striker plate 32 can be held in its latched position. Striker plate 32 has an unlock recess 39 for releasably receiving a latch point 40 of latch plate 26 so that striker plate 32 can be held in its unlocked position. A tab 42 projects upwardly from a corner of striker plate 32.

A catch plate 44 is mounted adjacent to latch plate 26 and striker plate 32. Catch plate 44 includes a pair of bores 46 and 48 for receiving pivot pins 22 and 24, respectively. Catch plate 44 includes a downward opening central recess 50 for receiving the striker member 12. A catch tab 52 projects horizontally from a lower portion of plate 44 and towards latch plate 26. A catch tab 54 projects horizontally from a lower end corner of plate 44 and towards striker plate 32.

Coil springs 43 and 45 have coils which are mounted on pivot studs 28 and 34, respectively. Spring 43 has an arm 47 which engages catch tab 52 and an arm 49 which engages an outer side of latch plate 26. Spring 45 has an arm 51 which engages catch tab 54 and an arm 53 which engages an outer side of striker plate 32.

A lever 60 is pivotally supported on pivot pin 22 by pivot stud or bearing 62 which is mounted on pivot pin 22 which forms a second pivot axis. Lever 60 has a bore 64 which receives pivot stud 62 and a notch 66 in one side thereof for receiving latch member 30 and which forms an engagement point. A spring 68 is coupled between lever 60 and a back plate 70, and is biased to urge lever 60 clockwise viewing FIGS. 1 and 2. Preferably, pivot pin 22 forms both the first and second pivots axes. However, the lever 60 and the latch plate 26 could be pivotal about different pivot axes (not shown).

The generally rectangular back plate 70 is mounted on pivot pins 22 and 24 so that lever 60 is held between back plate 70 and catch plate 44. Back plate 70 includes a pair of bores 72 and 74 for receiving pivot pins 22 and 24, respectively. Back plate 70 includes a downward opening central recess 76 for receiving the striker member 12. A stop tab 78 projects horizontally from a central upper portion of plate 70 and towards catch plate 44. Tab 78 is engagable with lever 60 to limits its pivoting away from latch member 30. Spacer washers 67 and 69 are mounted on the pins 22 and 24 between back plate 70 and lever 60 keep the longer lever 60 spaced apart from the back plate 70. Alternatively, the spacers 67 and 69 could be built in to the back mounting plate 70.

Figure 3:
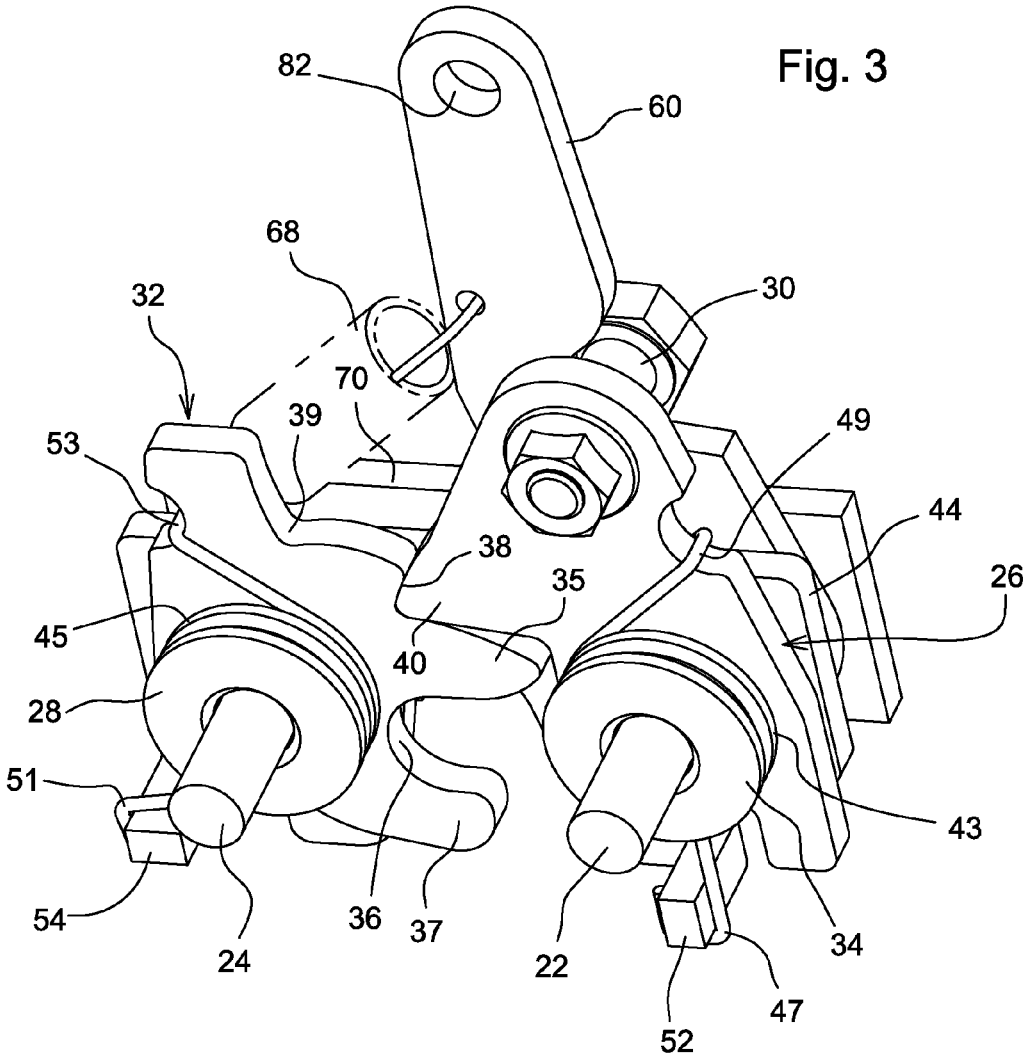
FIG. 3 is a front perspective view of the latch assembly of FIG. 1.

A release link 80 is received in a bore 82 near the outer end of lever 60 which forms a connection point. A handle (not shown) is attached to link 80 so that an operator can pull on link 80 and pivot lever 60 counter-clockwise viewing FIGS. 1 and 2. Except for the lever 60, the latch assembly 10 is similar to a prior art production. The link 80 is coupled to the lever 60 at an attachment point formed by the bore 82 near an outer end of the lever 60. A distance between the pivot pin 22 and the bore 82 is longer than the radial length of the latch plate 26. This longer length of the lever 60 provides additional force when an operator pulls on link 80 to pivot latch plate 26 to its unlatched position away from striker plate 32. Alternatively, the latch pin 30 could be mounted on the lever 60 so as to be engagable with a recess (not shown) formed on an inner side of the latch plate 26. As best seen in FIG. 3, the latch plate 26, the strike plate 32, catch plate 44, lever 60 and mounting plate 70 all have generally flat parallel bodies. As best seen in FIGS. 1 and 3, the lever 60 and the latch plate 26 both extend in substantially the same direction from the pivot pin 22 when the latch plate 26 is in the latched position.

Referring now to FIG. 3, the latch assembly 10 is shown in its latched state, wherein the striker member 12 would be received within recess 36, but the striker member 12 is not shown for reasons of clarity. The latch point 40 of latch plate 26 is received in recess 38 and releasable holds striker plate 32 in the latched position.

When lever 60 is pivoted clockwise viewing FIG. 3, this pivots latch member clockwise and removes latch point 40 from recess 38. This allows spring 53 to pivot striker plate 32 clockwise to its unlock position which orients recess 36 downwardly and allows the latch assembly 10 to be moved upwardly and away from the striker member 12 (not shown). When lever 60 is then released, spring 43 will rotate latch plate 26 counter-clockwise until latch point 40 moves into unlock recess 39, whereupon the latch plate 26 will hold striker plate 32 in its unlock position.

Now, when the latch assembly 10 is moved downwardly onto the striker member 12, the striker member 12 will be received by the downwardly opening recess 36. As the latch assembly 10 continues its downward movement, the striker member 12 will engage finger 35 and pivot striker plate 32 counter-clockwise. This pivoting of striker plate 32 will cause latch plate 26 to pivot clockwise against the bias of spring 43 as latch point 40 slides along the surface of finger 35. However, because latch plate 26 is separate from the lever 60, the latch plate 26 can pivot in clockwise direction without having to overcome the resistance of the lever 60 and the linkage 80 to which the lever 60 is attached. As a result, the latch assembly 10 can easily pivot into its latched position without any interference from the lever 60 or the linkage 80, but can also benefit from the additional leverage provided by the lever 60 when being moved into its unlatched position. The addition of the longer lever arm separate from the latch plate allows the lever to function only when the latch assembly is being unlatched. When the latch is being, closed only the smaller lever arm of the latch plate is used. This provides better leverage when opening the latch, but without the extra drag when closing the latch.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A latch assembly for latching a hood to a striker member, the latch assembly comprising:

a mounting plate fixedly attached to the hood;

a back plate fixedly attached to the mounting plate;

a catch plate fixedly attached to the mounting plate and positioned between the back plate and the mounting plate;

first and second pivot pins mounted to the mounting plate and extending through the back plate and the catch plate;

a lever pivotal on the first pivot pin and positioned between the back plate and the catch plate;

a striker plate pivotal on the second pivot pin and positioned between the catch plate and the mounting plate, the striker plate being pivotal to a locked position securing the latch assembly to the striker member and to an unlocked position wherein the latch assembly can be coupled to and uncoupled from the striker member;

a latch plate pivotal on the first pivot pin and positioned between the catch plate and the mounting plate, the latch plate being pivotal to a latched position holding the striker plate in its locked position and to an unlatched position which allows the striker plate to be pivoted out of its locked position;

a latch pin fixed to the latch plate and projecting away from the mounting plate, the latch pin being releasably engagable with the lever, and the lever having a notch for receiving the latch pin, the lever being engagable with the latch pin to move the latch plate from the latched position to the unlatched position;

a lever spring biased to urge the lever away from the latch pin; and a tab projecting from a central edge portion of the back plate and towards the catch plate, the tab being fixed with respect to the hood and being engagable with the lever to limit its pivoting away from the latch pin.

2. The latch assembly of claim 1, wherein:

the tab is formed by a bent portion of the back plate.

3. The latch assembly of claim 1, wherein:

the lever spring has a first end coupled to a corner portion of the back plate and a second end coupled to a connection point on the lever, said connection point being spaced apart from the back plate in a direction which is transverse to an axis of the first pivot pin.

4. The latch assembly of claim 1, wherein:

the latch pin is spaced apart from the back plate in a direction which is transverse to an axis of the first pivot pin.

* * * * *